US010382869B2

(12) United States Patent
Shimoda

(10) Patent No.: US 10,382,869 B2
(45) Date of Patent: Aug. 13, 2019

(54) ELECTRONIC APPARATUS

(71) Applicant: KYOCERA CORPORATION, Kyoto (JP)

(72) Inventor: Tetsuya Shimoda, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/604,315

(22) Filed: May 24, 2017

(65) Prior Publication Data

US 2017/0257707 A1 Sep. 7, 2017

Related U.S. Application Data

(63) Continuation of application No. PCT/JP2015/082339, filed on Nov. 18, 2015.

(30) Foreign Application Priority Data

Nov. 26, 2014 (JP) ..... 2014-238768

(51) Int. Cl.
*H04R 7/04* (2006.01)
*H04R 17/00* (2006.01)
*H04R 1/02* (2006.01)

(52) U.S. Cl.
CPC ..... *H04R 17/00* (2013.01); *H04R 1/025* (2013.01); *H04R 1/028* (2013.01); *H04R 7/04* (2013.01);
(Continued)

(58) Field of Classification Search
CPC ..... H04R 1/2892; H04R 1/2896; H04R 7/04; H04R 2440/05; H04R 2499/11; H04R 2307/023
See application file for complete search history.

(56) References Cited

U.S. PATENT DOCUMENTS 6,650,759 B1 * 11/2003 Nakamura ..... H04R 7/122 181/171
9,351,067 B2 * 5/2016 Kamitani ..... H04R 1/28
(Continued)

FOREIGN PATENT DOCUMENTS

JP 59-214399 12/1984
JP 2003-163990 A 6/2003
(Continued)

OTHER PUBLICATIONS

International Search Report and Written Opinion dated Jan. 12, 2016 in corresponding Japanese Patent Application No. PCT/JP2015/082339.

*Primary Examiner* — Curtis A Kuntz
*Assistant Examiner* — Ryan Robinson
(74) *Attorney, Agent, or Firm* — Duane Morris LLP

(57) ABSTRACT

An electronic apparatus is disclosed. In one embodiment, an electronic apparatus comprises a panel, a piezoelectric vibrator, a first bonding member, and a second bonding member. The piezoelectric vibrator is located on an inner surface of the panel. The first bonding member is located between the panel and the piezoelectric vibrator to bond the piezoelectric vibrator to the panel. The second bonding member is located between the panel and the piezoelectric vibrator to bond the piezoelectric vibrator to the panel and has an elastic modulus lower than an elastic modulus of the first bonding member.

8 Claims, 8 Drawing Sheets

(52) U.S. Cl.
CPC ..... *H04R 2430/01* (2013.01); *H04R 2460/13* (2013.01); *H04R 2499/11* (2013.01)

(56) References Cited

U.S. PATENT DOCUMENTS

| | | | | |
|---|---|---|---|---|
| 2012/0025335 | A1* | 2/2012 | Leclair | H01L 23/057 257/416 |
| 2013/0301856 | A1* | 11/2013 | Kim | H04R 7/26 381/190 |
| 2014/0158456 | A1* | 6/2014 | Inglis | H04R 7/125 181/168 |
| 2015/0086047 | A1* | 3/2015 | Horii | H04R 7/045 381/151 |
| 2015/0104047 | A1 | 4/2015 | Izumi | |
| 2016/0127836 | A1* | 5/2016 | Zaitsu | H04R 7/045 455/550.1 |

FOREIGN PATENT DOCUMENTS

| | | | |
|---|---|---|---|
| JP | 2007-180827 | A | 7/2007 |
| JP | 2014-007497 | A | 1/2014 |
| JP | 2014-057264 | A | 3/2014 |

* cited by examiner

ELECTRONIC APPARATUS

CROSS-REFERENCE TO RELATED APPLICATION

The present application is a continuation based on PCT Application No. PCT/JP2015/082339, filed on Nov. 18, 2015, which claims the benefit of Japanese Application No. 2014-238768, filed on Nov. 26, 2014. PCT Application No. PCT/JP2015/282339 is entitled "ELECTRONIC DEVICE" and Japanese Application No. 2014-238768 is entitled "ELECTRONIC APPARATUS". The contents of which are incorporated by reference herein in their entirety.

FIELD

Embodiments of the present disclosure relate to electronic apparatuses.

BACKGROUND

Various techniques have conventionally been proposed for electronic apparatuses.

SUMMARY

An electronic apparatus is disclosed. In one embodiment, an electronic apparatus comprises a panel, a piezoelectric vibrator, a first bonding member, and a second bonding member. The piezoelectric vibrator is located on an inner surface of the panel. The first bonding member is located between the panel and the piezoelectric vibrator to bond the piezoelectric vibrator to the panel. The second bonding member is located between the panel and the piezoelectric vibrator to bond the piezoelectric vibrator to the panel and has an elastic modulus lower than an elastic modulus of the first bonding member.

DETAILED DESCRIPTION

External Appearance of Electronic Apparatus

Figure 1:
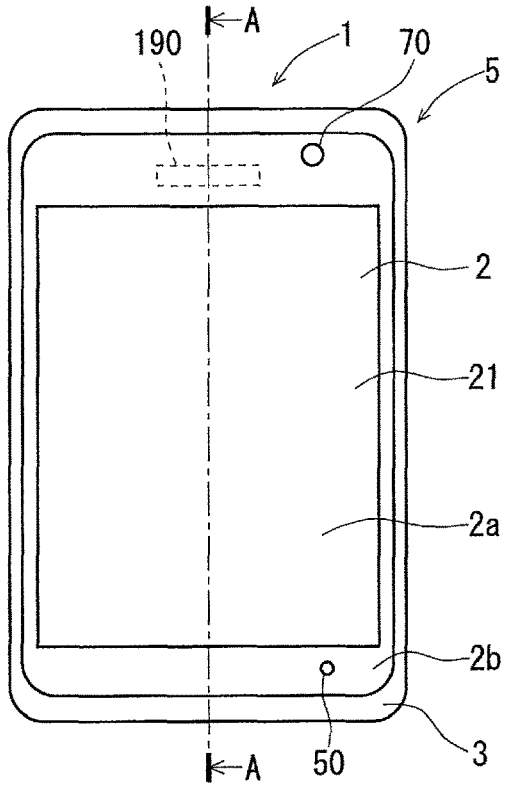
FIG. 1 illustrates a front view of an external appearance of an electronic apparatus.
Figure 2:
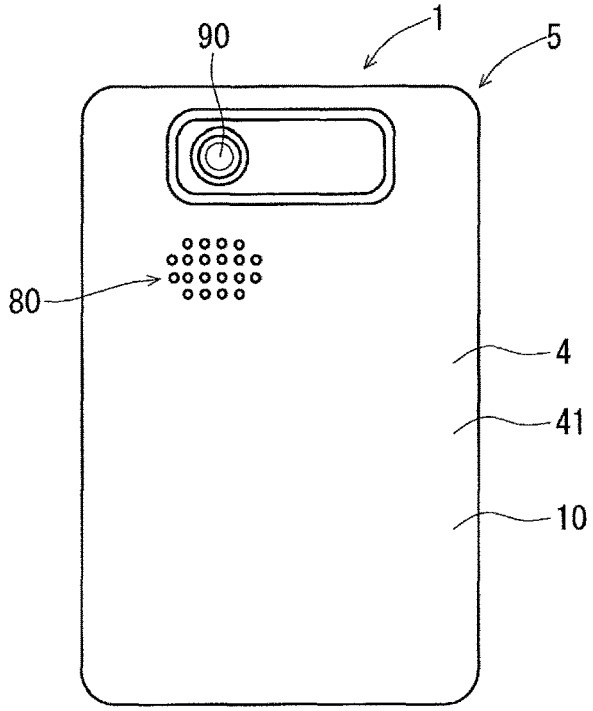
FIG. 2 illustrates a rear view of the external appearance of the electronic apparatus.
Figure 3:
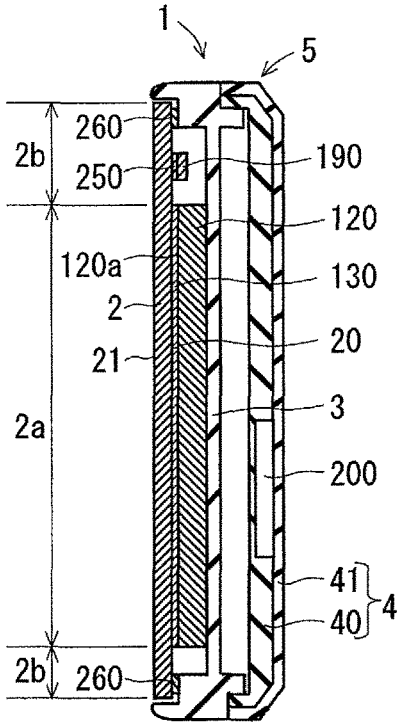
FIG. 3 illustrates a structure of the electronic apparatus viewed in cross section.
Figure 4:
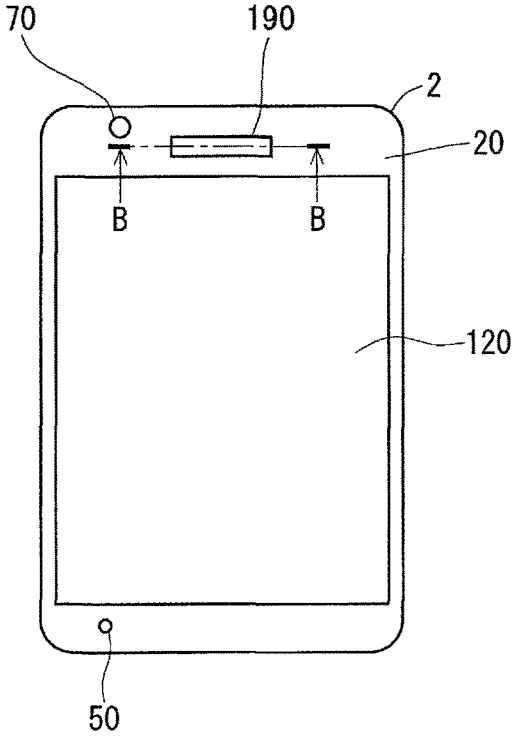
FIG. 4 illustrates a plan view of a cover panel.

FIGS. 1 and 2 respectively illustrate a front view and a rear view of an external appearance of an electronic apparatus 1. FIG. 3 illustrates a structure of the electronic apparatus 1 viewed in cross section along the line A-A of FIG. 1. FIG. 4 illustrates a rear view of a cover panel 2 of the electronic apparatus 1. Attached to the cover panel 2 illustrated in FIG. 4 are a piezoelectric vibrator 190 and a display panel 120 of the electronic apparatus 1. The electronic apparatus 1 is, for example, a mobile phone such as a smartphone.

As illustrated in FIGS. 1 to 4, the electronic apparatus 1 includes the transparent cover panel 2 that covers a display surface 120*a* of the display panel 120 (FIG. 3), a front case 3 that supports the cover panel 2, and a rear case 4 attached to the front case 3. The cover panel 2, the front case 3, and the rear case 4 each form part of the exterior of the electronic apparatus 1. The rear case 4 includes a case body 40 and a cover member 41. The case body 40 is attached to the front case 3 and accommodates a battery 200, and the cover member 41 is attached to the case body 40 from a rear surface 10 side of the electronic apparatus 1. The battery 200 accommodated in the case body 40 is covered with the cover member 41. The cover panel 2, the front case 3, and the rear case 4 form an exterior case 5 of the electronic apparatus 1. The electronic apparatus 1 has, for example, an approximately rectangular plate shape in a plan view.

The cover panel 2 forms the front portion, except a peripheral end (peripheral portion) of the front portion, of the electronic apparatus 1. The front case 3 and the rear case 4 form the peripheral end of the front portion, a side portion of the electronic apparatus 1, and a rear portion of the electronic apparatus 1. The front case 3 and the rear case 4 are each made of, for example, resin and metal. The resin is, for example, a polycarbonate resin, an ABS resin, or a nylon-based resin. The metal is, for example, aluminum. Provided in the space enclosed by the front case 3 and the rear case 4 is a printed circuit board (not shown) having various components such as a CPU 101 and a DSP 102 mounted thereon. The CPU 101 and the DSP 102 will be described below.

The cover panel 2 may have a plate shape. In a plan view, the cover panel 2 may have an approximately rectangular shape. The longitudinal direction of the cover panel 2 corresponds to the vertical direction of the electronic apparatus 1. As illustrated in FIG. 3, the cover panel 2 has a first main surface 20 and a second main surface 21. The first main surface 20 is an inner surface that faces the display surface 120*a* of the display panel 120. The second main surface 21 is an outer surface opposite to the first main surface 20. The second main surface 21 forms part of the front surface of the electronic apparatus 1. The first main surface 20 is hereinafter also referred to as an "inner main surface 20", and the second main surface 21 is hereinafter also referred to as an "outer main surface 21".

The cover panel 2 is made of, for example, sapphire. Sapphire is a single crystal based on aluminum oxide ($Al_2O_3$). Herein, sapphire refers to a single crystal having a purity of $Al_2O_3$ of approximately 90% or more. The purity of $Al_2O_3$ is preferably greater than or equal to 99% such that the cover panel is scratchproof and less prone to break and chip. The cover panel 2 may be made of crystalline materials other than sapphire, such as diamond, zirconia, titania, crystal, lithium tantalite, and aluminum oxynitride. Similarly to the above, each of these materials is preferably a single crystal having a purity of approximately 90% or more such that the cover panel is scratchproof and less prone to break and chip. The cover panel 2 may be made of acrylic resin or glass. The cover panel 2 may be a multilayer composite panel (laminated panel). For example, the cover panel 2 may be a double-layer composite panel including a layer of sapphire located on the surface of the electronic apparatus 1 and a layer of glass (a glass panel) laminated on the layer of sapphire. The cover panel 2 may be a triple-layer composite panel including a layer of sapphire (a first sapphire panel) located on the surface of the electronic apparatus 1, a layer of glass (a glass panel) laminated on the first sapphire panel, and another layer of sapphire (a second sapphire panel) laminated on the glass panel.

The inner main surface 20 and the outer main surface 21 of the cover panel 2 may be parallel to the a-plane of sapphire. The longitudinal direction of the cover panel 2 may be parallel to the c-axis of sapphire. Alternatively, the short-length direction of the cover panel 2 may be parallel to the c-axis of sapphire.

The cover panel 2 includes a display portion (display window) 2*a* transmitting the display of the display panel 120. The display portion 2*a* has, for example, a rectangular shape in a plan view. The visible light output from the display panel 120 passes through the display portion 2*a* and is emitted to the outside of the electronic apparatus 1. The user visually recognizes information displayed on the display panel 120 through the display portion 2*a* from the outside of the electronic apparatus 1.

A peripheral end 2*b* surrounding the display portion 2*a* of the cover panel 2 is mostly black because of a film or the like laminated thereon or a coating applied thereto. Thus, most of the peripheral end 2*b* is a non-display area that does not transmit the display of the display panel 120.

As illustrated in FIG. 3, a touch panel 130 is attached to the inner main surface 20 of the cover panel 2. The display panel 120 being a display is attached to a main surface of the touch panel 130 opposite to its another main surface on the inner main surface 20 side. That is, the display panel 120 is installed on the inner main surface 20 of the cover panel 2 with the touch panel 130 therebetween. The display panel 120 is sandwiched between the cover panel 2 and the front case 3. A portion of the cover panel 2 facing the display panel 120 is the display portion 2*a*. The user can provide various instructions to the electronic apparatus 1 by operating the display portion 2*a* of the cover panel 2 using a finger or the like.

As illustrated in FIG. 1, a microphone hole 50 is provided in the lower end of the cover panel 2. As illustrated in FIG. 2, speaker holes 80 are provided in the rear surface 10 of the electronic apparatus 1, specifically, in the outer surface of the cover member 41 of the rear case 4.

Provided in the exterior case 5 are a front imaging unit 160, a rear imaging unit 170, and the piezoelectric vibrator 190, which will be described below. As illustrated in FIGS. 3 and 4, the piezoelectric vibrator 190 is located on the inner main surface 20 of the cover panel 2. The piezoelectric vibrator 190 is fixed to the cover panel 2 with an bonding member 250 therebetween.

A front-surface-lens transparent part 70, through which an imaging lens of the front imaging unit 160 in the exterior case 5 is visually recognized from the outside of the electronic apparatus 1, is located in the upper end of the cover panel 2. A rear-surface-lens transparent part 90, through which an imaging lens of the rear imaging unit 170 in the exterior case 5 is visually recognized from the outside of the electronic apparatus 1, is located in the rear surface 10 of the electronic apparatus 1.

As illustrated in FIG. 3, the cover panel 2 is attached to the front case 3 with a bonding member 260. Specifically, the inner main surface 20 of the cover panel 2 is attached to the front case 3 with the bonding member 260 therebetween. The bonding member 260 is, for example, a double-sided tape or an adhesive. For example, the entire perimeter of the peripheral end of the inner main surface 20 of the cover panel 2 is attached to the front case 3 with the bonding member 260.

Electrical Configuration of Electronic Apparatus

Figure 5:
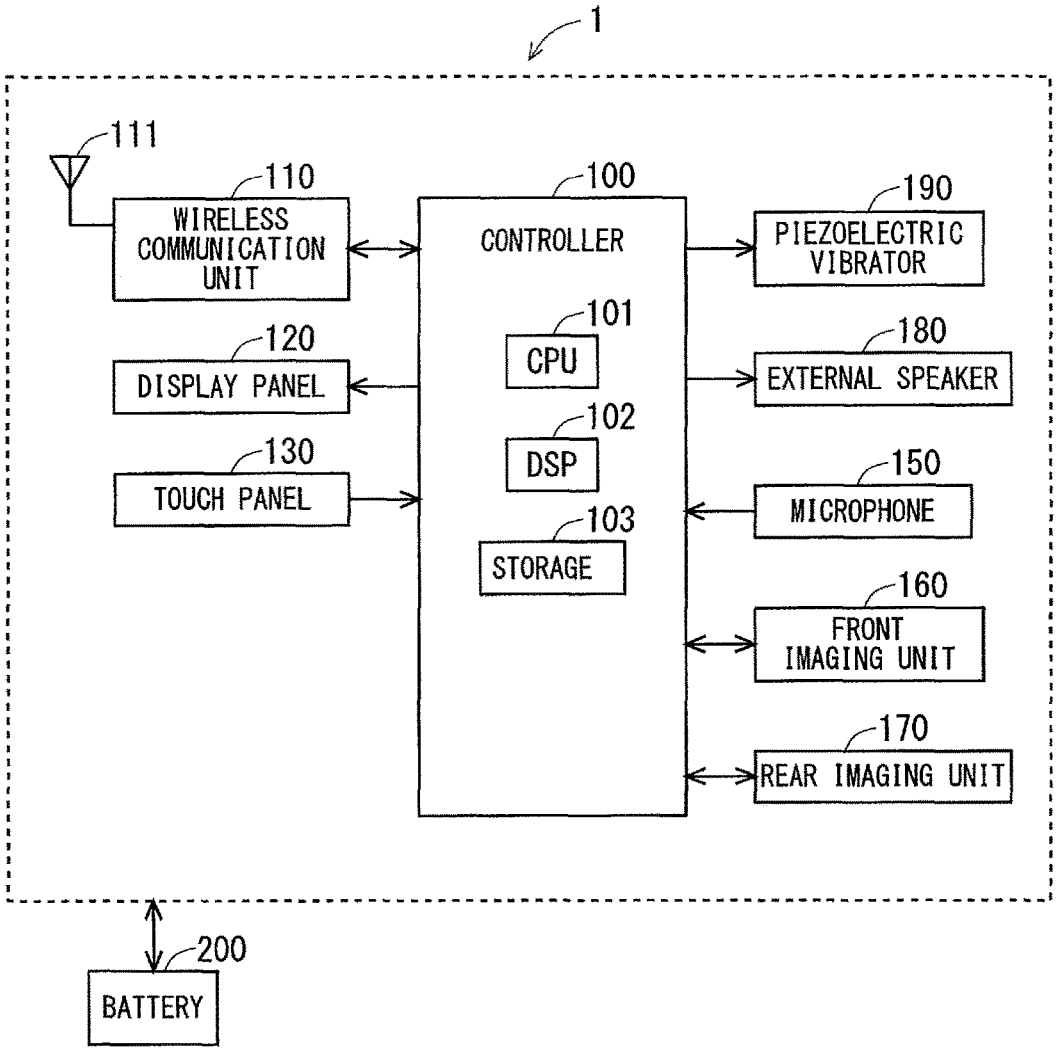
FIG. 5 illustrates an electrical configuration of the electronic apparatus.

FIG. 5 illustrates a block diagram showing an electrical configuration of the electronic apparatus 1. As illustrated in FIG. 5, the electronic apparatus 1 includes a controller 100, a wireless communication unit 110, the display panel 120, the touch panel 130, and the piezoelectric vibrator 190. The electronic apparatus 1 also includes a microphone 150, the front imaging unit 160, the rear imaging unit 170, an external speaker 180, and the battery 200. The exterior case 5 accommodates the constituent components, except for the cover panel 2, of the electronic apparatus 1.

The controller 100 includes, for example, the central processing unit (CPU) 101, the digital signal processor (DSP) 102, and a storage 103. The controller 100 can manage the overall operation of the electronic apparatus 1 by controlling other constituent components of the electronic apparatus 1.

The storage 103 is a non-transitory recording medium readable by the controller 100 (the CPU 101 and the DSP 102) such as a read only memory (ROM) and a random access memory (RAM). The storage 103 can store, for example, a main program and a plurality of application programs. The main program is a control program for controlling the electronic apparatus 1, specifically, for controlling the constituent components such as the wireless communication unit 110 and the display panel 120 of the electronic apparatus 1. The CPU 101 and the DSP 102 execute various programs stored in the storage 103 to achieve various functions of the controller 100.

The storage 103 may include a non-transitory computer readable recording medium other than the ROM and the RAM. The storage 103 may include a compact hard disk drive, a solid state drive (SSD), and the like.

The wireless communication unit 110 includes an antenna 111. The wireless communication unit 110 can receive a signal from a mobile phone different from the electronic apparatus 1 or a signal from communication equipment such as a web server connected to the Internet through the antenna 111 via a base station. The wireless communication unit 110 can amplify and down-convert the received signal and then output a resultant signal to the controller 100. The controller 100 can, for example, demodulate the received signal to acquire a sound signal (sound information) indicating a sound or music contained in the received signal.

The wireless communication unit 110 can also up-convert and amplify a transmission signal generated by the controller 100 and containing a sound signal or the like to wirelessly transmit the processed transmission signal from the antenna 111. The transmission signal from the antenna 111 is received, via the base station, by a mobile phone different from the electronic apparatus 1 or communication equipment connected to the Internet.

The display panel 120 is, for example, a liquid crystal panel or an organic electroluminescent (EL) panel. The display panel 120 can display various types of information such as characters, signs, and graphics under the control of the controller 100. The information which the display panel 120 displays is visually recognized by the user of the electronic apparatus 1 through the display portion 2*a* of the cover panel 2.

The touch panel 130 can detect an operation performed on the display portion 2*a* of the cover panel 2 with an operator such as a finger. The touch panel 130 is, for example, a projected capacitive touch panel. When the user performs an operation on the display portion 2*a* with the operator such as a finger, an electrical signal corresponding to the operation is input from the touch panel 130 to the controller 100. The controller 100 can specify, based on the electrical signal from the touch panel 130, the purpose of the operation performed on the display portion 2*a* and accordingly perform a process appropriate to the purpose.

The front imaging unit 160 includes the imaging lens, an image sensor, and the like. The front imaging unit 160 can image a still image and a moving image based on the control by the controller 100. The imaging lens of the front imaging unit 160 can be visually recognized from the front-surface-lens transparent part 70 in the front surface of the electronic apparatus 1. Therefore, the front imaging unit 160 can image an object located on the front surface side (cover panel 2 side) of the electronic apparatus 1.

The rear imaging unit 170 includes the imaging lens, an image sensor, and the like. The rear imaging unit 170 can image a still image and a moving image based on the control by the controller 100. The imaging lens of the rear imaging unit 170 can be visually recognized from the rear-surface-lens transparent part 90 in the rear surface 10 of the electronic apparatus 1. Therefore, the rear imaging unit 170 can image an object located on the rear surface 10 side of the electronic apparatus 1.

The microphone 150 can convert a sound received from the outside of the electronic apparatus 1 into an electrical sound signal and then output the sound signal to the controller 100. The sound from the outside of the electronic apparatus 1 is taken inside the electronic apparatus 1 through the microphone hole 50 in the front surface of the cover panel 2 and then is received by the microphone 150. The microphone hole 50 may be located in the side surface of the electronic apparatus 1 or may be located in the rear surface 10.

The external speaker 180 is, for example, a dynamic speaker. The external speaker 180 can convert an electrical sound signal from the controller 100 into a sound and then output the sound. The sound output from the external speaker 180 is, for example, output to the outside through the speaker holes 80 in the rear surface 10 of the electronic apparatus 1. The sound output through the speaker holes 80 is set to a volume such that the sound can be heard in the place apart from the electronic apparatus 1.

The piezoelectric vibrator 190 is located on the inner main surface 20 of the cover panel 2 on the front surface of the electronic apparatus 1, as mentioned above. The piezoelectric vibrator 190 can vibrate based on a drive voltage applied by the controller 100. The controller 100 can generate a drive voltage based on a sound signal and then apply the drive voltage to the piezoelectric vibrator 190. The controller 100 causes the piezoelectric vibrator 190 to vibrate based on the sound signal, so that the cover panel 2 vibrates based on the sound signal. A reception sound is accordingly transmitted from the cover panel 2 to the user. The volume of the reception sound is set to a degree such that the sound is adequately audible to the user, with the cover panel 2 close to his/her ear. The reception sound transmitted from the cover panel 2 to the user will be described below in detail.

The battery 200 can output the power for the electronic apparatus 1. The power output from the battery 200 is supplied to the electronic components such as the controller 100 and the wireless communication unit 110 of the electronic apparatus 1.

Details of Piezoelectric Vibrator

Figure 6:
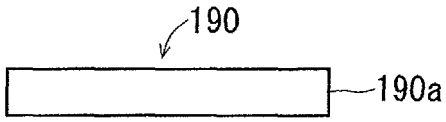
FIG. 6 illustrates a top view of a structure of a piezoelectric vibrator.
Figure 7:
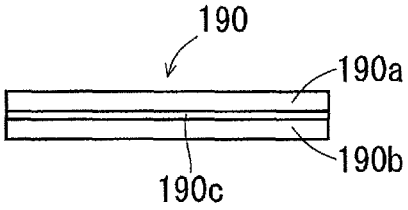
FIG. 7 illustrates a side view of the structure of the piezoelectric vibrator.

FIGS. 6 and 7 illustrate a top view and a side view, respectively, showing a structure of the piezoelectric vibrator 190. As illustrated in FIGS. 6 and 7, the piezoelectric vibrator 190 has a long shape in one direction. Specifically, the piezoelectric vibrator 190 has a long and narrow rectangular plate shape in a plan view. The piezoelectric vibrator 190 has, for example, a bimorph structure. The piezoelectric vibrator 190 includes a first piezoelectric ceramic plate 190*a* and a second piezoelectric ceramic plate 190*b* that are bonded to each other with a shim material 190*c* therebetween.

In the piezoelectric vibrator 190, when a positive voltage is applied to the first piezoelectric ceramic plate 190*a* and a negative voltage is applied to the second piezoelectric ceramic plate 190*b*, the first piezoelectric ceramic plate 190*a* extends along the longitudinal direction and the second piezoelectric ceramic plate 190*b* contracts along the longitudinal direction. Accordingly, as illustrated in FIG. 8, the piezoelectric vibrator 190 is bent into a convex shape, with the first piezoelectric ceramic plate 190*a* being the outside.

In contrast, in the piezoelectric vibrator 190, when a negative voltage is applied to the first piezoelectric ceramic plate 190*a* and a positive voltage is applied to the second piezoelectric ceramic plate 190*b*, the first piezoelectric ceramic plate 190*a* contracts along the longitudinal direction and the second piezoelectric ceramic plate 190*b* extends along the longitudinal direction. Accordingly, as illustrated in FIG. 9, the piezoelectric vibrator 190 is bent into a convex shape, with the second piezoelectric ceramic plate 190*b* being the outside.

Figure 8:
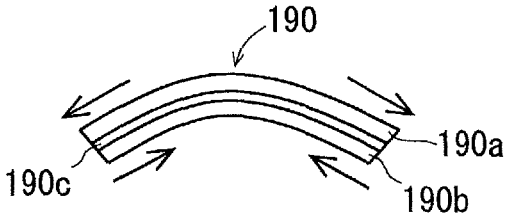
FIGS. 8 and 9 illustrate how the piezoelectric vibrator vibrates while being bent.
Figure 9:
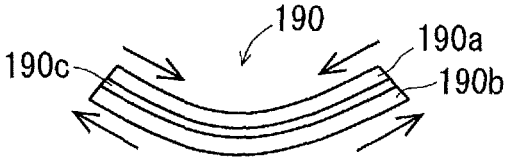

The piezoelectric vibrator 190 vibrates while being bent along the longitudinal direction by alternately taking the state of FIG. 8 and the state of FIG. 9. The controller 100 applies, between the first piezoelectric ceramic plate 190*a* and the second piezoelectric ceramic plate 190*b*, an alternating current (AC) voltage in which the polarity alternates. Consequently, the piezoelectric vibrator 190 vibrates while being bent along the longitudinal direction.

The piezoelectric vibrator 190 having such a structure is located on the peripheral end of the inner main surface 20 of the cover panel 2. Specifically, the piezoelectric vibrator 190 is located on a central portion in the short-length direction of the cover panel 2 (a central portion in the transverse direction of the electronic apparatus 1) on the upper end of the inner main surface 20 of the cover panel 2. The piezoelectric vibrator 190 is disposed in such a manner that its longitudinal direction corresponds to the short-length direction of the cover panel 2. The piezoelectric vibrator 190 can accordingly vibrate while being bent along the short-length direction of the cover panel 2. The center in the longitudinal direction of the piezoelectric vibrator 190 coincides with the center in the short-length direction of the cover panel 2 on the upper end of the inner main surface 20 of the cover panel 2.

The piezoelectric vibrator 190 illustrated in FIGS. 6 to 9 includes only one structure composed of the first piezoelectric ceramic plate 190*a* and the second piezoelectric ceramic plate 190*b* bonded together with the shim material 190*c* therebetween. Alternatively, the piezoelectric vibrator 190 may include a lamination of the above-mentioned structures. In this case, the piezoelectric vibrator 190 preferably includes a lamination composed of 28 layers or more. The piezoelectric vibrator 190 more preferably includes a lamination composed of 44 layers or more. Thus, the vibration is adequately transmitted to the cover panel 2.

The piezoelectric vibrator 190 may be made of an organic piezoelectric material such as polyvinylidene fluoride and polylactic acid, instead of the piezoelectric ceramic material. Specifically, the piezoelectric vibrator 190 may include a lamination of first and second piezoelectric plates made of a polylactic acid film. A transparent electrode made of, for example, indium tin oxide (ITO) may be disposed on the piezoelectric plates.

Generation of Reception Sound

The piezoelectric vibrator 190 causes the cover panel 2 to vibrate, so that an air conduction sound and a tissue conduction sound are transmitted from the cover panel 2 to the user. In other words, a vibration of the piezoelectric vibrator 190 itself is transmitted to the cover panel 2, so that the air conduction sound and the tissue conduction sound are transmitted from the cover panel 2 to the user.

Here, the term "air conduction sound" is a sound recognized in the human brain by the vibration of an eardrum due to a sound wave (air vibration) which enters an external auditory meatus ("ear hole"). The term "tissue conduction sound" is a sound recognized in the human brain by the vibration of the eardrum due to the vibration of an auricle transmitted to the eardrum. The air conduction sound and the tissue conduction sound will be described below in detail.

Figure 10:
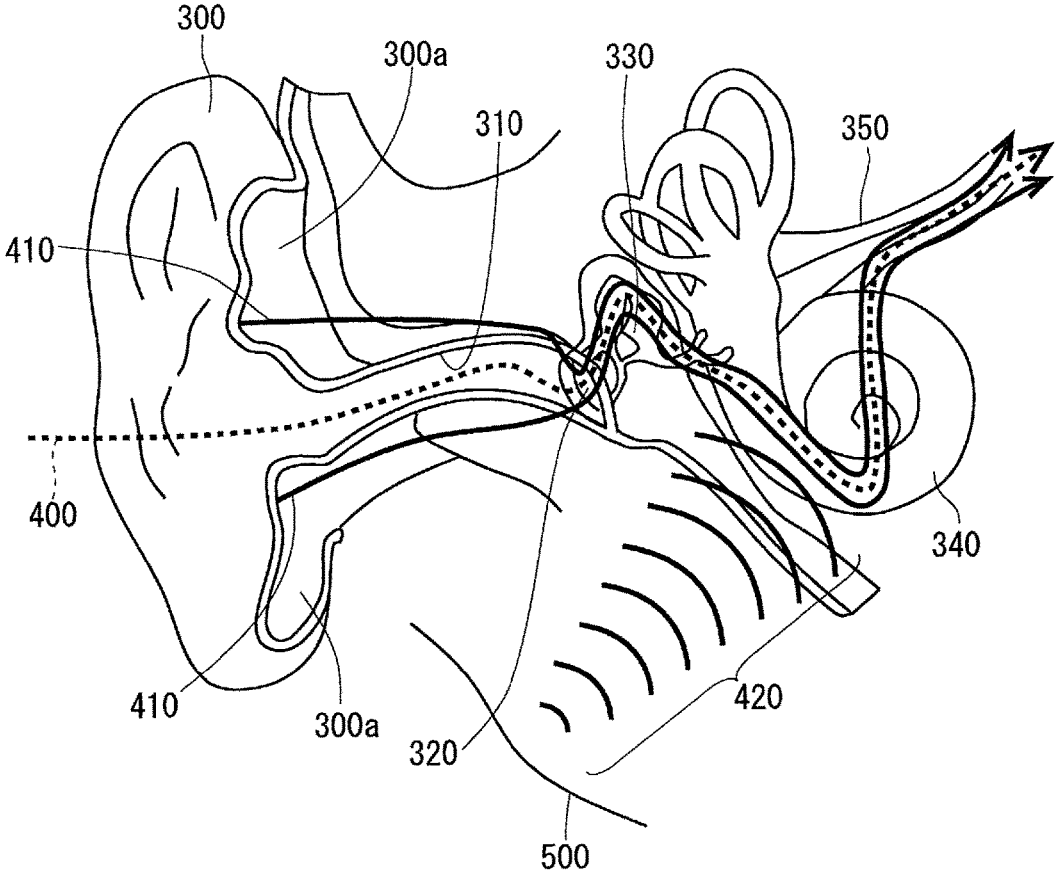
FIG. 10 illustrates a view for describing an air conduction sound and a tissue conduction sound.

FIG. 10 illustrates a view for describing the air conduction sound and the tissue conduction sound. FIG. 10 illustrates the structure of the ear of the user of the electronic apparatus 1. In FIG. 10, a dotted line 400 indicates a conduction path of a sound signal (sound information) while the air conduction sound is recognized in the brain. A solid line 410 indicates the conduction path of a sound signal while the tissue conduction sound is recognized in the brain.

When the piezoelectric vibrator 190 fixed to the cover panel 2 vibrates based on the electrical sound signal indicating the reception sound, the cover panel 2 vibrates, and a sound wave is output from the cover panel 2. When the user moves the cover panel 2 of the electronic apparatus 1 close to an auricle 300 of the user by holding the electronic apparatus 1 in a hand, or, when the cover panel 2 of the electronic apparatus 1 is set to (brought into contact with) the auricle 300 of the user, the sound wave output from the cover panel 2 enters an external auditory meatus hole 310. The sound wave from the cover panel 2 travels through the external auditory meatus hole 310 and causes an eardrum 320 to vibrate. The vibration of the eardrum 320 is transmitted to an auditory ossicle 330, and the auditory ossicle 330 vibrates. Then, the vibration of the auditory ossicle 330 is transmitted to a cochlea 340 and is converted into an electrical signal in the cochlea 340. The electrical signal is transmitted to the brain through an acoustic nerve 350 and the reception sound is recognized in the brain. In this manner, the air conduction is transmitted from the cover panel 2 to the user.

Further, when the user puts the cover panel 2 of the electronic apparatus 1 to the auricle 300 of the user by holding the electronic apparatus 1 in a hand, the auricle 300 is vibrated by the cover panel 2, which is vibrated by the piezoelectric vibrator 190. The vibration of the auricle 300 is transmitted to the eardrum 320, and thus, the eardrum 320 vibrates. The vibration of the eardrum 320 is transmitted to the auditory ossicle 330, and thus, the auditory ossicle 330 vibrates. The vibration of the auditory ossicle 330 is transmitted to the cochlea 340 and is converted into an electrical signal in the cochlea 340. The electrical sound is transmitted to the brain through the acoustic nerve 350 and the reception sound is recognized in the brain. In this manner, the tissue conduction sound is conducted from the cover panel 2 to the user. An auricle cartilage 300*a* in the inside of the auricle is also shown in FIG. 10.

A bone conduction sound is a sound recognized in the human brain by the vibration of the skull and direct stimulation of the inner ear such as the cochlea caused by the vibration of the skull. In FIG. 10, in a case where a jawbone 500 vibrates, the transmission path of the sound signal while the bone conduction sound is recognized in the brain is indicated by a plurality of arcs 420.

As described above, the air conduction sound and the tissue conduction sound can be transmitted from the cover panel 2 to the user of the electronic apparatus 1 due to an appropriate vibration of the cover panel 2 through the vibration of the piezoelectric vibrator 190. The user can hear the air conduction sound from the cover panel 2 by moving the cover panel 2 close to an ear (auricle). Further, the user can hear the air conduction sound and the tissue conduction sound from the cover panel 2 by bringing the cover panel 2 into contact with an ear (auricle). The structure of the piezoelectric vibrator 190 is contrived to appropriately transmit the air conduction sound and the tissue conduction sound to the user. Various advantage are achieved by configuring the electronic apparatus 1 to transmit the air conduction sound and the tissue conduction sound to the user.

For example, since the user can hear a sound when putting the cover panel 2 to the ear, the user can perform communication with little concern for the position of the electronic apparatus 1 with respect to the ear.

If there is a large amount of ambient noise, the user can make the noise less audible by strongly putting the cover panel 2 to the ear while turning up the volume of the tissue conduction sound. Accordingly, the user can appropriately perform communication, regardless of the large amount of ambient noise.

In addition, even with earplugs or earphones on his/her ears, the user can recognize the reception sound from the electronic apparatus 1 by putting the cover panel 2 to the ear (more specifically, the auricle). Further, even with headphones on his/her ear, the user can recognize the reception sound from the electronic apparatus 1 by putting the cover panel 2 to the ear.

The portion of the cover panel 2 having the piezoelectric vibrator 190 fixed thereto vibrates relatively easily. Thus, the user can make the sound from the cover panel 2 more audible by moving the upper end (particularly, the central portion in the short-length direction of the upper end) of the cover panel 2, to which the piezoelectric vibrator 190 is fixed, close to the ear or putting the portion to the ear.

How to Fix Piezoelectric Vibrator

Figure 11:
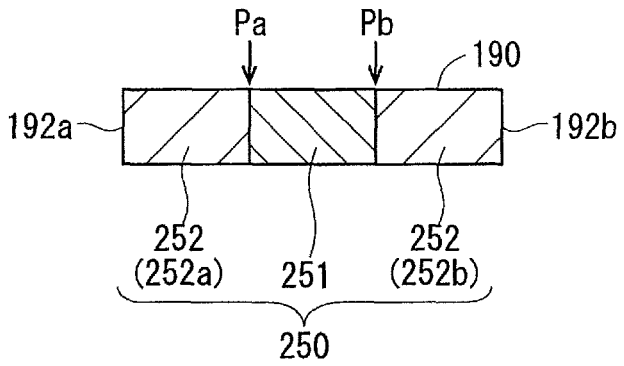
FIG. 11 illustrates a plan view of an bonding member fixed to the piezoelectric vibrator.
Figure 12:
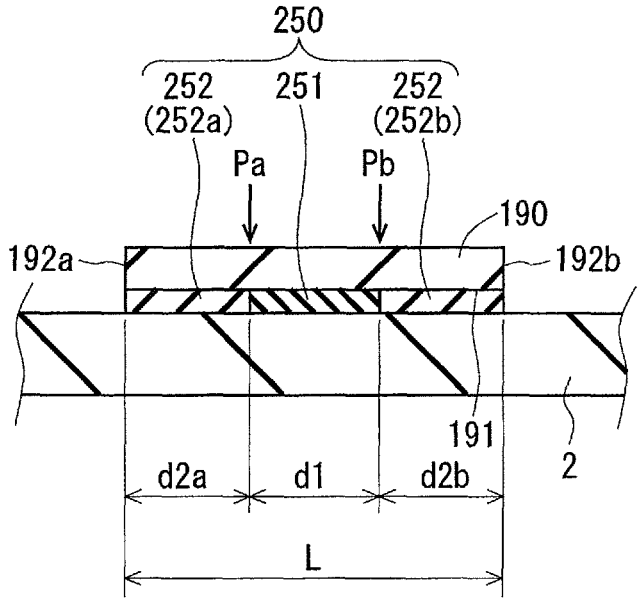
FIG. 12 illustrates the structure of the electronic apparatus, partially enlarged and viewed in cross section.

FIG. 11 illustrates a plan view of the piezoelectric vibrator 190 having the bonding member 250 mounted thereon and viewed from the bonding member 250 side. FIG. 12 illustrates the structure enlarged and viewed in cross section along the line B-B of FIG. 4. The bonding member 250 may be fixed to the cover panel 2, and then, the piezoelectric vibrator 190 may be fixed to the cover panel 2 with the bonding member 250 therebetween. Alternatively, the bonding member 250 may be fixed to the piezoelectric vibrator 190, and then, the piezoelectric vibrator 190 may be fixed to the cover panel 2 with the bonding member 250 therebetween. The "longitudinal direction" hereinafter refers to the longitudinal direction of the piezoelectric vibrator 190, in other words, a direction in which the piezoelectric vibrator 190 vibrates while being bent. The "short-length direction" hereinafter refers to the short-hand direction of the piezoelectric vibrator 190.

As illustrated in FIGS. 11 and 12, the bonding member 250 located between the piezoelectric vibrator 190 and the cover panel 2 lies on the entirety of a main surface 191 of the piezoelectric vibrator 190 on the cover panel 2 side. The bonding member 250 extends from one end to another end of the piezoelectric vibrator 190 both in the longitudinal direction and in the short-length direction.

The bonding member 250 is composed of a first bonding member 251 and a second bonding member 252. With reference to FIGS. 11 and 12, the first bonding member 251 is indicated by lines that slope upward from right to left and the second bonding member 252 is indicated by lines that slope upward from left to right. The elastic modulus of the second bonding member 252 is lower than the elastic modulus of the first bonding member 251. In other words, the second bonding member 252 is softer than the first bonding member 251.

The first bonding member 251, which is relatively hard, may be an adhesive. Examples of such an adhesive include an epoxy adhesive. The second bonding member 252, which is relatively soft, may be a double-sided tape. Examples of such a double-sided tape include a waterproof double-sided tape including, as a base material, a foam material such as polyethylene. The first bonding member 251 and the second bonding member 252 may be made of materials other than the above. In the case where the first bonding member 251 is an adhesive, the second bonding member 252 may be a foam filler. In the case where the second bonding member 252 is a waterproof double-sided tape including a foam material as a base material, the first bonding member 251 may be a common waterproof double-sided tape including no foam material as a base material (a waterproof double-sided tape including, as a base material, a material harder than the foam material). The second bonding member 252 preferably includes a foam material.

The first bonding member 251 is located between the cover panel 2 and the central portion in the longitudinal direction (the direction in which the piezoelectric vibrator 190 vibrates while being bent) of the piezoelectric vibrator 190. The second bonding member 252 is located between the cover panel 2 and both ends in the longitudinal direction of the piezoelectric vibrator 190.

The second bonding member 252 is composed of a first portion 252*a* and a second portion 252*b*. The first portion 252*a* is located between the cover panel 2 and one end in the longitudinal direction of the piezoelectric vibrator 190. The second portion 252*b* is located between the cover panel 2 and the other end in the longitudinal direction of the piezoelectric vibrator 190.

The first portion 252*a* extends in the longitudinal direction from a first end 192*a* in the longitudinal direction of the piezoelectric vibrator 190 to a position Pa, which is at a distance of one third of L from the first end 192*a*, toward a second end 192*b* in the longitudinal direction of the piezoelectric vibrator 190. L is the length in the longitudinal direction of the piezoelectric vibrator 190. Thus, d2*a*, which is the length in the longitudinal direction of the first portion 252*a*, is one third of L being the length of the piezoelectric vibrator 190.

The second portion 252*b* extends in the longitudinal direction from the second end 192*b* of the piezoelectric vibrator 190 to a position Pb, which is at a distance of one third of L from the second end 192*b*, toward the first end 192*a* of the piezoelectric vibrator 190. Thus, d2*b*, which is the length in the longitudinal direction of the second portion 252*b*, is one third of L being the length of the piezoelectric vibrator 190.

The first bonding member 251 lies in the longitudinal direction between the first portion 252*a* and the second portion 252*b*. The first bonding member 251 is sandwiched between the first portion 252*a* and the second portion 252*b* and is joined to the first portion 252*a* and the second portion 252*b*.

Thus, the piezoelectric vibrator 190 is fixed to the cover panel 2 with both the first bonding member 251 having a higher elastic modulus and the second bonding member 252 having a lower elastic modulus. In other words, the piezoelectric vibrator 190 is fixed to the cover panel 2 with the hard first bonding member 251 and the soft second bonding member 252.

When being fixed to the cover panel 2 solely with a hard bonding member such as an adhesive, the piezoelectric vibrator 190 vibrates poorly. Accordingly, the cover panel 2 vibrates poorly through the vibration of the piezoelectric vibrator 190.

When being fixed to the cover panel 2 solely with a soft bonding member such as a double-sided tape, the piezoelectric vibrator 190 can vibrate easily. However, the vibration of the piezoelectric vibrator 190 is poorly transmitted to the cover panel 2. Accordingly, the cover panel 2 vibrates poorly through the vibration of the piezoelectric vibrator 190, as in the above-mentioned case.

In the case where the piezoelectric vibrator 190 is fixed to the cover panel 2 with the hard first bonding member 251 and the soft second bonding member 252, the part of the piezoelectric vibrator 190 fixed to the cover panel 2 with soft second bonding member 252 therebetween can vibrate easily. The vibration of the piezoelectric vibrator 190 can be easily transmitted from the part of the piezoelectric vibrator 190 fixed to the cover panel 2 with the hard first bonding member 251 therebetween, to the cover panel 2. The cover panel 2 can accordingly vibrate easily through the vibration of the piezoelectric vibrator 190. Thus, a sound is emitted from the cover panel 2 at a high sound-pressure level. The sound is audibly transmitted from the cover panel 2 to the user. The piezoelectric vibrator 190 fixed to the cover panel 2 with the hard first bonding member 251 and the soft second bonding member 252 offers significant advantages to the cover panel 2 made of sapphire, which would otherwise vibrate poorly due to its material characteristics.

As illustrated in FIGS. 8 and 9, the piezoelectric vibrator 190 vibrates while being bent in the longitudinal direction, with the bend in the piezoelectric vibrator 190 made from its central portion toward its ends. In a case where the ends in the longitudinal direction of the piezoelectric vibrator 190 are less movable, the piezoelectric vibrator 190 poorly vibrates while being bent. In the electronic apparatus 1, meanwhile, the soft second bonding member 252 is located between the cover panel 2 and one end of the piezoelectric vibrator 190 in the direction in which the piezoelectric vibrator 190 vibrates while being bent, and thus, the end is more movable. The piezoelectric vibrator 190 can easily vibrate while being bent. The cover panel 2 can accordingly vibrate easily through the vibration of the piezoelectric vibrator 190. The soft second bonding member 252 may be located between the cover panel 2 and both ends of the piezoelectric vibrator 190 in the direction in which the piezoelectric vibrator 190 vibrates while being bent. The piezoelectric vibrator 190 can more easily vibrate while being bent. The cover panel 2 can accordingly vibrate more easily through the vibration of the piezoelectric vibrator 190.

The piezoelectric vibrator 190 vibrates while being bent in the longitudinal direction, with the bend in the piezoelectric vibrator 190 being made from its central portion toward its ends, as mentioned above. In a case where the central portion in the longitudinal direction of the piezoelectric vibrator 190 is not securely fixed to the cover panel 2 and is movable, the piezoelectric vibrator 190 poorly vibrates while being bent. In the electronic apparatus 1, meanwhile, the hard first bonding member 251 is located between the cover panel 2 and the central portion of the piezoelectric vibrator 190 in the direction in which the piezoelectric vibrator 190 vibrates while being bent, and thus, the central portion is less movable. The piezoelectric vibrator 190 can easily vibrate while being bent. The cover panel 2 can accordingly vibrate more easily through the vibration of the piezoelectric vibrator 190.

The bonding member 250 lies on the entirety of the main surface 191 of the piezoelectric vibrator 190 on the cover panel 2 side. Thus, the piezoelectric vibrator 190 is less prone to slip off the cover panel 2 when the electronic apparatus 1 is, for example, dropped.

An experiment was conducted to make a comparison between a sound pressure caused by a sound emitted from the cover panel 2 having the piezoelectric vibrator 190 fixed thereto with the first bonding member 251 and the second bonding member 252 and a sound pressure caused by a sound emitted from the cover panel 2 having the piezoelectric vibrator 190 fixed thereto solely with a double-sided tape. (The elastic modulus of this double-sided tape was higher than the elastic modulus of the double-sided tape used as the second bonding member 252 and was lower than the elastic modulus of the adhesive used as the first bonding member 251). The sound pressure caused by a sound emitted from the cover panel 2 having the piezoelectric vibrator 190 fixed thereto with the first bonding member 251 and the second bonding member 252 was, on average, 2.24 dB higher in the frequency range of 200 Hz to 2 kHz and 2.57 dB higher at a frequency of 1 kHz than the sound pressure caused by a sound emitted from the cover panel 2 having the piezoelectric vibrator 190 fixed thereto solely with the double-sided tape.

The configuration of the bonding member 250 is not limited to the example illustrated in FIGS. 11 and 12. In the illustration of FIGS. 11 and 12, d2*a* being the length of the first portion 252*a*, d1 being the length of the first bonding member 251, and d2*b* being the length of the second portion 252*b* are in the ratio of 1:1:1, which is not limited thereto. These lengths may be in the ratio of, for example, 1:2:1 or 2:1:2.

Figure 13:
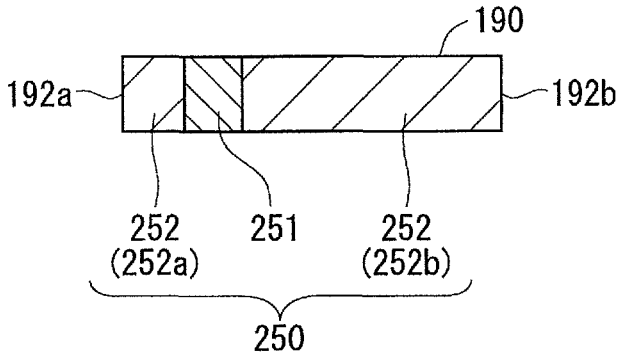
FIGS. 13 to 16 each illustrate a plan view of the bonding member fixed to the piezoelectric vibrator.

As illustrated in FIG. 13, no first bonding member 251 may be located between the cover panel 2 and the central portion in the longitudinal direction of the piezoelectric vibrator 190.

Figure 14:
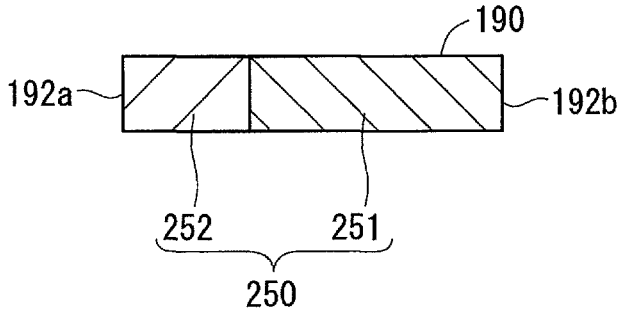

As illustrated in FIG. 14, no second bonding member 252 may be located between the cover panel 2 and one end in the longitudinal direction of the piezoelectric vibrator 190.

Figure 15:
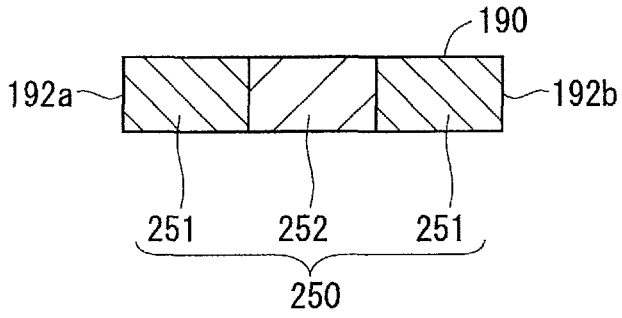

As illustrated in FIG. 15, the first bonding member 251 may be located between the cover panel 2 and both ends in the longitudinal direction of the piezoelectric vibrator 190, and the second bonding member 252 may be located between the cover panel 2 and the central portion in the longitudinal direction of the piezoelectric vibrator 190.

Figure 16:
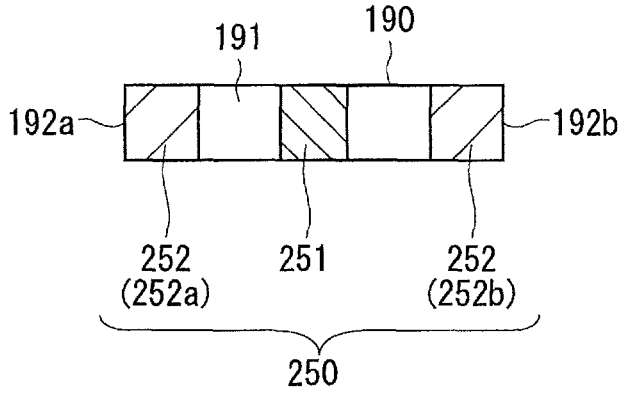

As illustrated in FIG. 16, it is not always required that the bonding member 250 lie on the entirety of the main surface 191 of the piezoelectric vibrator 190 on the cover panel 2 side.

In the second bonding member 252, the elastic modulus of the first portion 252*a* may be different from the elastic modulus of the second portion 252*b*. For example, the first portion 252*a* and the second portion 252*b* may be double-sided tapes of different types. In this case, the elastic modulus of the double-sided tape used as the first portion 252*a* may be lower than the elastic modulus of the double-sided tape used as the second portion 252*b*.

Embodiments of the present disclosure, which have been applied to mobile phones in the above description, are also applicable to other electronic apparatuses. Embodiments of the present disclosure are applicable to, for example, tablet terminals and wearable electronic apparatuses to be worn on an arm or the like.

While the electronic apparatus 1 has been described above in detail, the above description is in all aspects illustrative and not restrictive. In addition, various modification described above are applicable in combination as long as they are consistent with each other. It is understood that numerous modifications which have not been exemplified can be devised without departing from the scope of the present disclosure.

What is claimed is:

1. An electronic apparatus comprising:

a panel;

a piezoelectric vibrator having a planar surface bonded to an inner planar surface of the panel, wherein the piezoelectric vibrator has a substantially planar shape in a non-vibrating state;

a first bonding member that is located between the panel and a first portion of the planar surface of the piezoelectric vibrator to bond the piezoelectric vibrator to the panel; and a second bonding member that is located between the panel and a second portion of the planar surface of the piezoelectric vibrator so as not to overlap with the first bonding member in a thickness direction of the panel, wherein the second bonding member bonds the piezoelectric vibrator to the panel, and has an elastic modulus lower than an elastic modulus of the first bonding member.

2. The electronic apparatus according to claim 1, wherein the piezoelectric vibrator vibrates while being bent along a predetermined direction.

3. The electronic apparatus according to claim 2, wherein the second bonding member is located between the panel and an end in the predetermined direction of the piezoelectric vibrator.

4. The electronic apparatus according to claim 3, wherein the second bonding member is located between the panel and both ends in the predetermined direction of the piezoelectric vibrator.

5. The electronic apparatus according to claim 2, wherein the first bonding member is located between the panel and a central portion in the predetermined direction of the piezoelectric vibrator.

6. An electronic apparatus comprising:

a panel;

a piezoelectric vibrator located on an inner surface of the panel;

a first bonding member that is located between the panel and the piezoelectric vibrator to bond the piezoelectric vibrator to the panel; and a second bonding member that is located between the panel and the piezoelectric vibrator so as not to overlap with the first bonding member in a thickness direction of the panel, wherein the second bonding member bonds the piezoelectric vibrator to the panel, and has an elastic modulus lower than an elastic modulus of the first bonding member, wherein the piezoelectric vibrator vibrates while being bent along a predetermined direction, wherein the first bonding member is located between the panel and a central portion in the predetermined direction of the piezoelectric vibrator, and wherein a bonding member composed of the first and second bonding members lies on the entirety of a surface of the piezoelectric vibrator on the panel side.

7. An electronic apparatus comprising:

a panel;

a piezoelectric vibrator located on an inner surface of the panel;

a first bonding member that is located between the panel and the piezoelectric vibrator to bond the piezoelectric vibrator to the panel; and a second bonding member that is located between the panel and the piezoelectric vibrator to bond the piezoelectric vibrator to the panel and has an elastic modulus lower than an elastic modulus of the first bonding member, wherein the second bonding member includes:

a first portion extending in the predetermined direction from one end in the predetermined direction of the piezoelectric vibrator to a position that is at a distance of one third of a length in the predetermined direction of the piezoelectric vibrator from the one end; and a second portion extending in the predetermined direction from another end in the predetermined direction of the piezoelectric vibrator to a position that is at a distance of one third of the length from the another end, and the first bonding member lies between the first portion and the second portion.

8. The electronic apparatus according to claim 1, wherein the panel is made of sapphire.

* * * * *